US006834649B1

(12) United States Patent
Kuo

(10) Patent No.: US 6,834,649 B1
(45) Date of Patent: Dec. 28, 2004

(54) ONE-WAY VALVE ON DIVING MASK

(76) Inventor: Tzong-Fuh Kuo, No. 21, Alley 5, Lane 49, How Gaang 1st Rd., Hsin Juang City, Taipei Hsien (TW)

( * ) Notice: Subject to any disclaimer, the term of this patent is extended or adjusted under 35 U.S.C. 154(b) by 0 days.

(21) Appl. No.: 10/824,078

(22) Filed: Apr. 13, 2004

(51) Int. Cl.[7] ..... A62B 9/02

(52) U.S. Cl. ..... 128/205.24; 128/201.28; 2/428

(58) Field of Search ..... 128/200.29, 201.11, 128/201.23, 201.24, 201.27, 201.28, 205.24, 205.25, 206.12, 206.15, 206.21, 207.12, 207.13; 2/428, 429, 426, 430, 446; 137/601.2, 907, 908

(56) References Cited

U.S. PATENT DOCUMENTS 4,856,120 A * 8/1989 Hart ..... 2/428
5,329,643 A * 7/1994 Sato ..... 2/428
5,608,920 A * 3/1997 Oliver et al. ..... 2/428
5,687,712 A * 11/1997 Semeia ..... 128/205.24
5,724,961 A * 3/1998 Tistrand ..... 128/205.24
6,598,239 B1 * 7/2003 Hsieh ..... 2/428

* cited by examiner

*Primary Examiner*—Henry Bennett
*Assistant Examiner*—Teena Mitchell
(74) *Attorney, Agent, or Firm*—Pro-Techtor Inter-National Services

(57) ABSTRACT

The present invention relates to a one-way valve including an inner base, a valve plate, an outer base, and a lid incorporating on a hole under a nose cover of a diving mask. The valve plate lying just on the hole thereof forms an outward-open-only valve, thereby preventing water from penetrating inside and being able to be blown open to exclude water out of the diving mask.

1 Claim, 3 Drawing Sheets

ONE-WAY VALVE ON DIVING MASK

BACKGROUND OF THE INVENTION (a) Field of the Invention

The present invention relates to an improved one-way valve incorporating on a diving mask, which prevents water from coming inside and can be blown open to drain water out of the diving mask.

(b) Description of the Prior Art

Referring to FIGS. 1 and 2. To drain water leaking inside a diving mask, due to water pressure and an individual's face shape not completely matching the diving mask, a conventional diving mask 10 may be fitted on the nose position with a one-way valve 100 comprising a soft valve plate 102 on a hard plastic valve seat 101, wherein an astro-fixture 1011 formed on top. Fitting the one-way valve 100 on the diving mask 10, water drained from the diving mask 10 will be blocked mostly by the astro-fixture 1011 and the valve seat 101, thereby forming a retro-flow, which creates additional efforts in blowing water out of the diving mask 10.

SUMMARY OF THE INVENTION

The invention relates to a one-way valve incorporated under a nose cover of a diving mask. The one-way valve thereof can be blown open to drain water, without being blocked, out of the diving mask.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
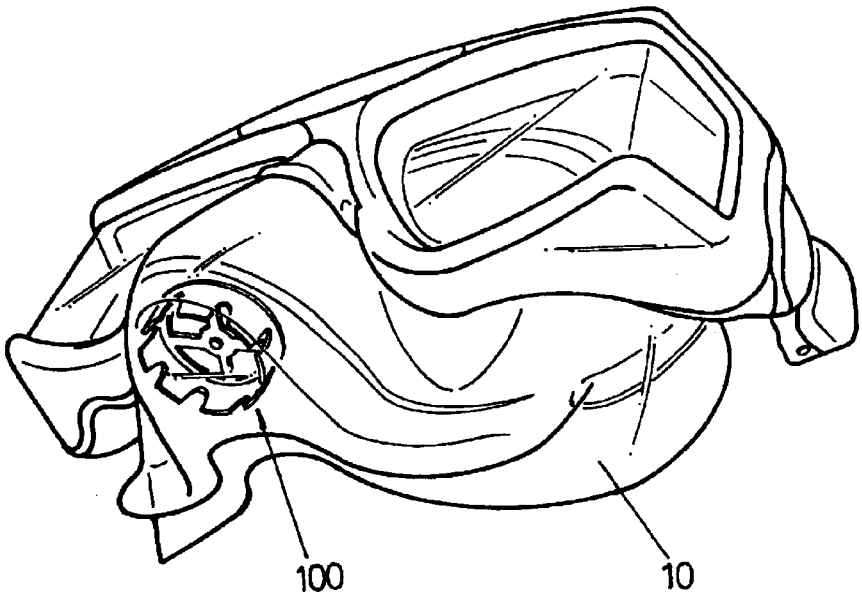
FIG.1 (PRIOR ART)
FIG. 1 shows a prospective view of a mask with a conventional one-way valve.
Figure 2:
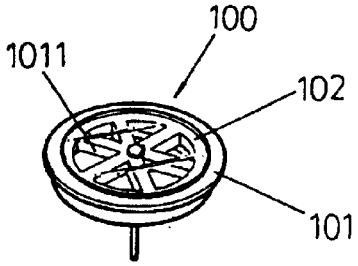
FIG.2 (PRIOR ART)
FIG. 2 shows a prospective view of a conventional one-way valve.
Figure 3:
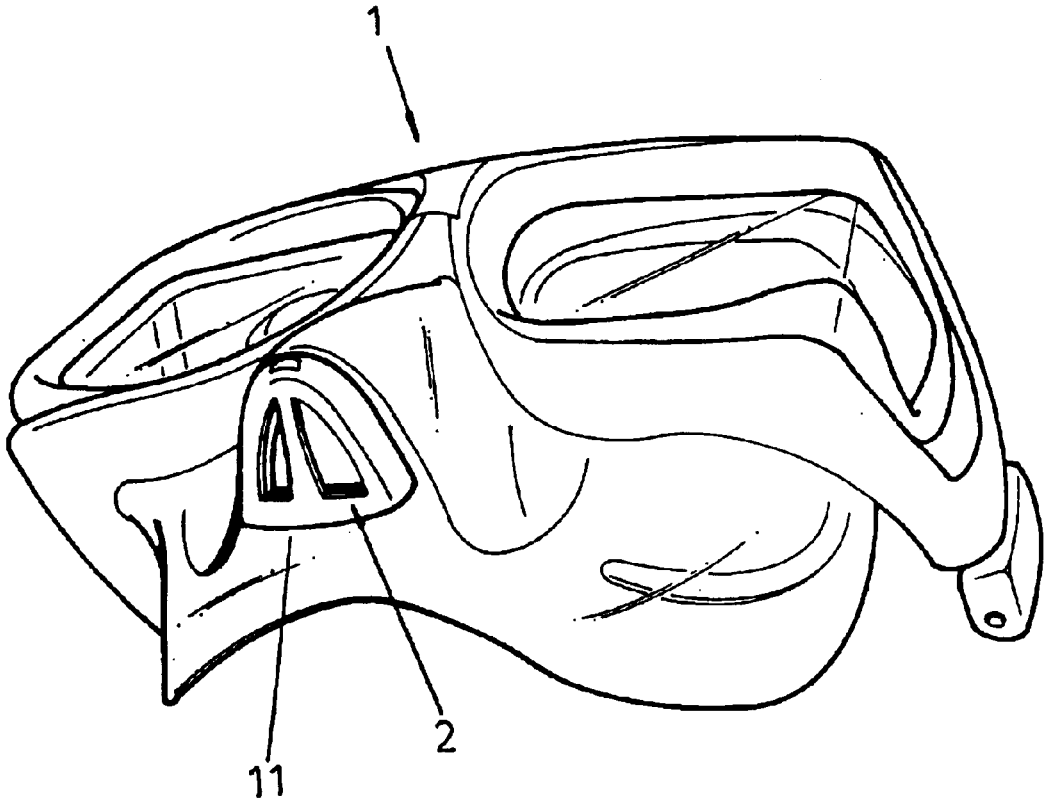
FIG. 3 shows a prospective view of the present invention.
Figure 4:
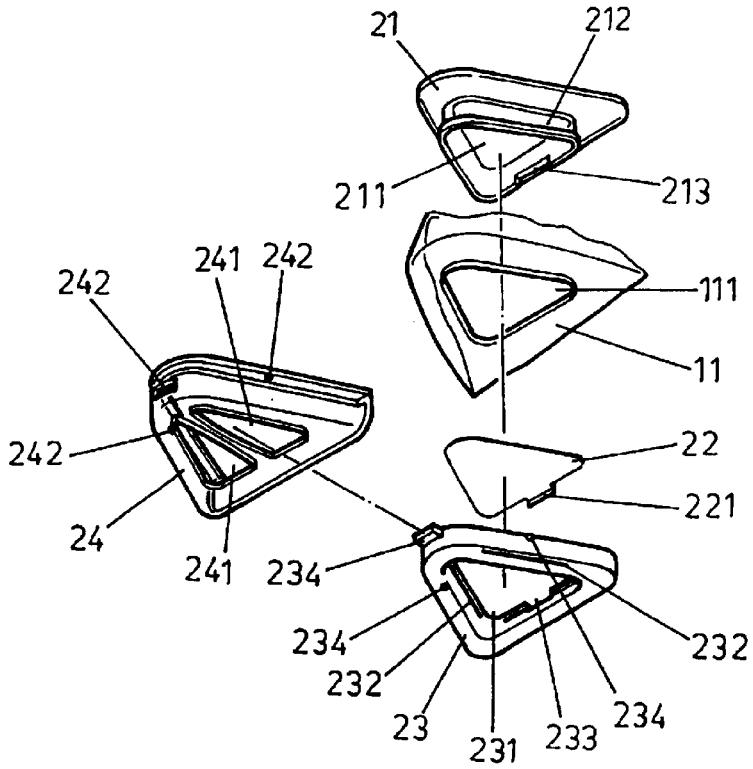
FIG. 4 shows an exploded elevational view of the present invention.
Figure 5:
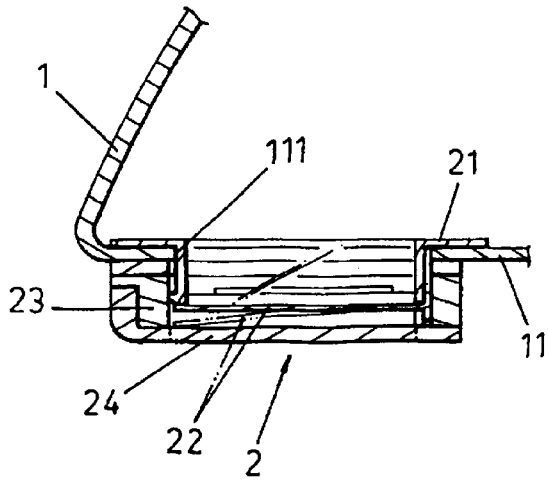
FIG. 5 shows a cross section view of the present invention.

Referring to FIGS. 3~5. The present invention comprises a one-way valve 2 on a hole 111 formed on a nose cover 11 of a diving mask 1, wherein the one-way valve 2 includes an inner base 21, a valve plate 22, an outer base 23, and a lid

24. A triangular base hole 211, identical to the hole 111 on the nose cover 11, is formed in the center of the inner base 21. A groove 212 is further formed on the outer perimeter of the triangular base hole 211, wherein a fixture hole 213 formed on one side. By inserting the groove 212 from inside through the hole 111 of the nose cover 11, the inner base 21 is firm fixed thereon. By inserting a fixture 221, formed on one side of the valve plate 22, into the fixture hole 213 on the inner base 21, the valve plate 22 thereby lying just on the triangular base hole 211, forming an one-way valve, outward open only. A triangular base hole 231, identical to the hole 111 on the nose cover 11, is formed inside the outer base 23, wherein a fixture strip 232, with a gap 233, formed on the inner perimeter. The valve plate 22 is firm fixed by inserting the fixture strip 232 into the groove 212 on the inner base 21 and fitting the gap 233 on the outer base 23 to the fixture 221 on the valve plate 22. Two drainage holes 241 are formed on the lid 24, wherein three positioning holes 242 formed inside the groove formed around the outer perimeter. By covering the lid 24 on the outer base 23, with three positioning projections 234 on the outer perimeter of the outer base 23 inserted into three positioning holes 242 on the lid 24, a one-way valve thereby formed, which prevents water from entering the diving mask 1 and can be blown open to drain water out of the diving mask 1.

In summary, the key to the present invention is only with a slim valve plate without any obstacle inside. The valve is effective in preventing water from coming inside and can be blown open to drain water out of the diving mask.

What is claimed is:

1. A one-way valve incorporated on a hole under a nose cover of a diving mask, comprising an inner base, with a base hole formed inside and a groove formed around an outer perimeter, whereon a fixture hole formed on one side thereof;

a valve plate covered on the base hole of the inner base, wherein a fixture formed on one side designed to be inserted into the fixture hole on the inner base;

an outer base, with a base hole formed inside, wherein, a fixture strip, with a gap, formed on an inner perimeter and positioning projections formed on the outer perimeter; by inserting the fixture strip into the groove on the inner base and fitting the gap on the outer base to the fixture on the valve plate, thereby fixing the valve plate in position;

a lid, whereon drainage holes formed on a face and positioning holes, formed inside a groove of the outer perimeter; to be filled by the positioning projections on the outer base.

* * * * *